US005949849A

United States Patent [19]

Hirano et al.

[11] Patent Number: 5,949,849

[45] Date of Patent: Sep. 7, 1999

[54] X-RAY GENERATOR AND ELECTROSTATIC REMOVER USING THE SAME

[75] Inventors: Masayuki Hirano; Tsutomu Inazuru; Takashi Koike, all of Hamamatsu, Japan

[73] Assignee: Hamamatsu Photonics K.K., Hamamatsu, Japan

[21] Appl. No.: 08/937,921

[22] Filed: Sep. 26, 1997

[30] Foreign Application Priority Data

Sep. 27, 1996 [JP] Japan ..... 8-256780

[51] Int. Cl.[6] ..... H01J 35/00

[52] U.S. Cl. ..... 378/121; 378/141; 378/143

[58] Field of Search ..... 378/121, 119, 378/127, 128, 129, 139, 140, 141, 142, 143

[56] References Cited

U.S. PATENT DOCUMENTS

| | | | |
|---|---|---|---|
| 4,034,251 | 7/1977 | Haas | 378/140 |
| 4,075,526 | 2/1978 | Grubis . | |
| 4,384,360 | 5/1983 | Kitadate et al. . | |
| 4,827,371 | 5/1989 | Yost . | |
| 5,504,799 | 4/1996 | Suzuki . | |

FOREIGN PATENT DOCUMENTS

| | | |
|---|---|---|
| A1-0-275-592 | 7/1988 | European Pat. Off. . |
| B 37-5501 | 6/1937 | Japan . |
| A 59-16254 | 1/1984 | Japan . |
| 7-50594 | 5/1995 | Japan . |
| A-555-013 | 7/1943 | United Kingdom . |
| WO 94-05138 | 3/1994 | WIPO . |

*Primary Examiner*—David P. Porta
*Attorney, Agent, or Firm*—Oliff & Berridge, PLC

[57] ABSTRACT

To provide an X-ray generator capable of both being compact and containing an air-cooling mechanism, an X-ray generator according to the present invention houses within a protective case both an X-ray tube containing a cathode for irradiating a target with an electron beam, in which X-ray tube the target having a ground potential is fixed to the inner surface of an output window, which in turn is fixed to an electrically and thermally conductive output window support provided on the end of a bulb; and a power supply for driving the X-ray tube. A flange portion formed on the output window support so as to protrude externally contacts and is fixed to the thermally conductive protective case. As a result, heat near 100° C. generated continuously in the X-ray tube is transferred to the protective case and dissipated externally. The thus configured X-ray generator is best suited when used as an electrostatic remover for removing electrostatic accumulations on an object, such as an integrated circuit.

18 Claims, 7 Drawing Sheets

X-RAY GENERATOR AND ELECTROSTATIC REMOVER USING THE SAME

BACKGROUND OF THE INVENTION

1. Field of the Invention

The present invention relates to an X-ray generator and particularly to an X-ray generator in which a small-scale X-ray tube emitting soft X-ray is housed within a protective case. The present invention also relates to an electrostatic remover using the X-ray generator.

2. Description of the Prior Art

Japanese Patent Publication (Kokoku) No. HEI-7-50594 discloses one example of a conventional X-ray tube. In this X-ray tube, a filament heated by an electrical current flowing therethrough emits an electron beam, which is accelerated by a focus grid and the like and collides with the target at a high rate of speed. As a result, X-rays specific to the target materials are radiated outward from a translucent X-ray window provided in a spaced apart relation with the target. This type of X-ray tube reaches high temperatures and, therefore, must be cooled. A target ring which is fixed to the target and protrudes from the envelop (bulb) is provided for air cooling the X-ray tube, thereby maintaining the efficiency of the X-ray generation and preventing damage to the target. This type of X-ray tube is housed in a protective case including a power unit for generating a voltage of +9.5 kV and is incorporated inside the X-ray generator.

However, problems exist in conventional X-ray generators due to the configuration described above. In X-ray tubes of the type in which the target and translucent X-ray window are separated, the envelop is large, requiring a large space around the envelop to provide natural air-cooling. As a result, the protective case must also be large. Very small-type X-ray tubes in which the target and the translucent X-ray window (output window) are formed integrally were developed to solve the above problem. However, because of the very small size of this type of X-ray tube, the diameter of the envelop is also small, creating problems in achieving natural air-cooling and in incorporating the X-ray tube in existing protective cases.

SUMMARY OF THE INVENTION

In view of the problems described above, an object of the present invention is to provide an X-ray generator capable of containing an air-cooling structure end, at the same time, being of a compact size.

An X-ray generator according to the present invention has a protective case housing both an X-ray tube, in which a target having a ground potential is fixed to the inner surface of an output window, which in turn is fixed to an electrically and thermally conductive output window support provided on the end of a bulb, and the X-ray tube contains a cathode for irradiating the target with an electron beam; and a power supply for driving the X-ray tube. A flange portion formed on the output window support so as to protrude externally contacts and is fixed to the thermally conductive protective case.

Since the target in this X-ray generator has a grounded potential, a negative high potential such as −9.5 kV is applied to the filament from the power unit in the protective case. An electron beam is radiated from the cathode to collide with the ground-potential target, causing an X-ray to be emitted from the target and radiated externally from the output window.

In order to maintain the efficiency of the X-ray generation and to prevent damage to the target, the target and bulb must be cooled. With this configuration, the high-temperature target is fixed to an output window support member via the output window. The bulb is also fixed to the output window support member. Therefore, heat from the target and bulb is transferred to a flange portion formed on the output window support member, heating the flange portion to a high temperature. Since the flange portion is fixed so as to contact the thermally conductive protective case, heat from the flange portion transfers to the protective case and escapes into the outer air. Hence, the protective case itself serves as a cooling device. Accordingly, heat issued from the target, bulb, and the like is transferred to the protective case and released. An optimal cooling environment is created by the protective case itself. Since it is not necessary to create a cooling environment inside the protective case for the X-ray tube, the protective case can be made smaller, allowing the size of the X-ray generator to be decreased, as well.

In this configuration, an X-ray tube housing unit is provided on the power source case, which houses the power unit. It is desirable to interpose a flange portion between a first supporting plate formed on the front end of the X-ray tube housing unit and a second supporting plate provided on the front end of the protective case and opposing the first supporting plate. When using this type of configuration, the X-ray tube can easily be arranged inside the protective case, increasing the efficiency of assembling the X-ray generator and lowering production costs of the generator.

Further, it can be effective to position a thermally conductive intermediate member between the first supporting member and the second supporting member and to interpose the flange portion between these two supporting members via the intermediate member. When using this type of configuration, the intermediate member contacts the second supporting plate on the protective case, essentially expanding the heat-conducting channel for transferring heat from the flange portion to the second supporting plate and, therefore, accelerating heat dissipation from the protective case.

The X-ray generator described above is best suited when used as an electrostatic remover. Without specific modifications to the X-ray generator described above, it can be used as the electrostatic remover.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

An X-ray generator according to preferred embodiments of the present invention will be described while referring to the accompanying drawings.

Figure 1:
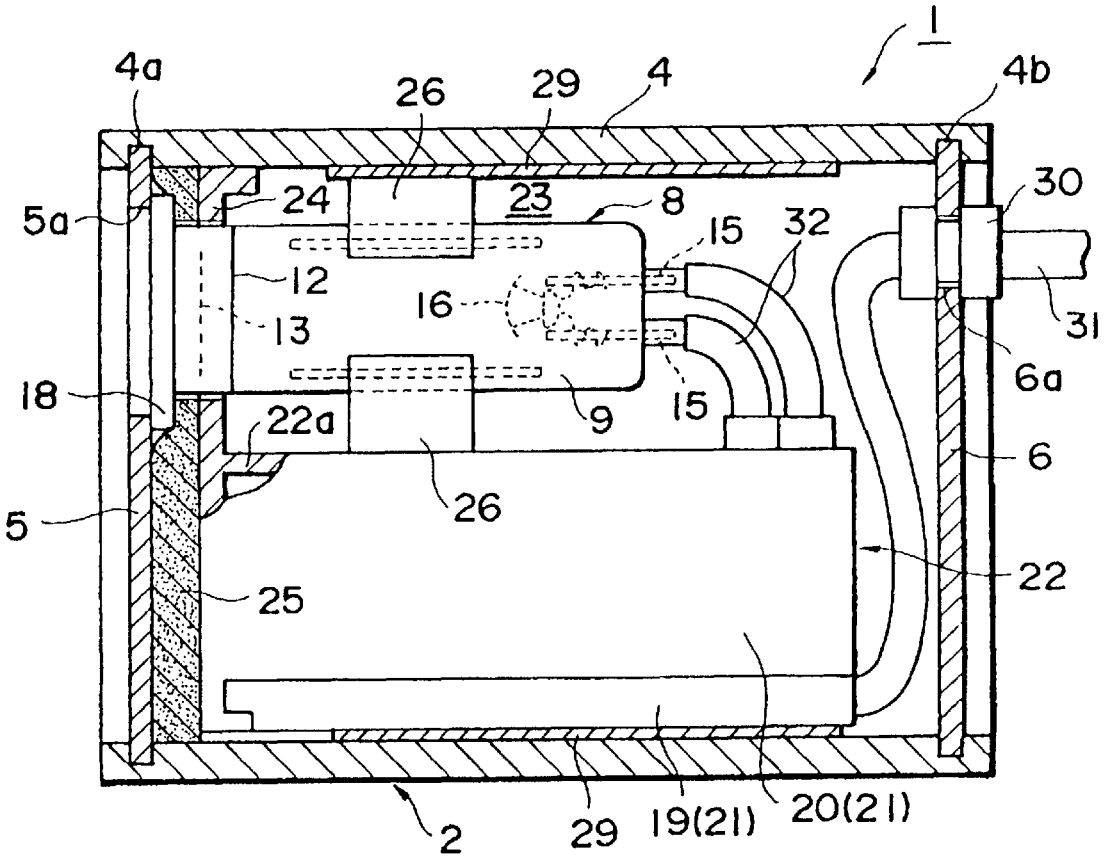
FIG. 1 is a horizontal cross-sectional diagram showing the structure of an X-ray generator according to the first embodiment of the present invention.
Figure 2:
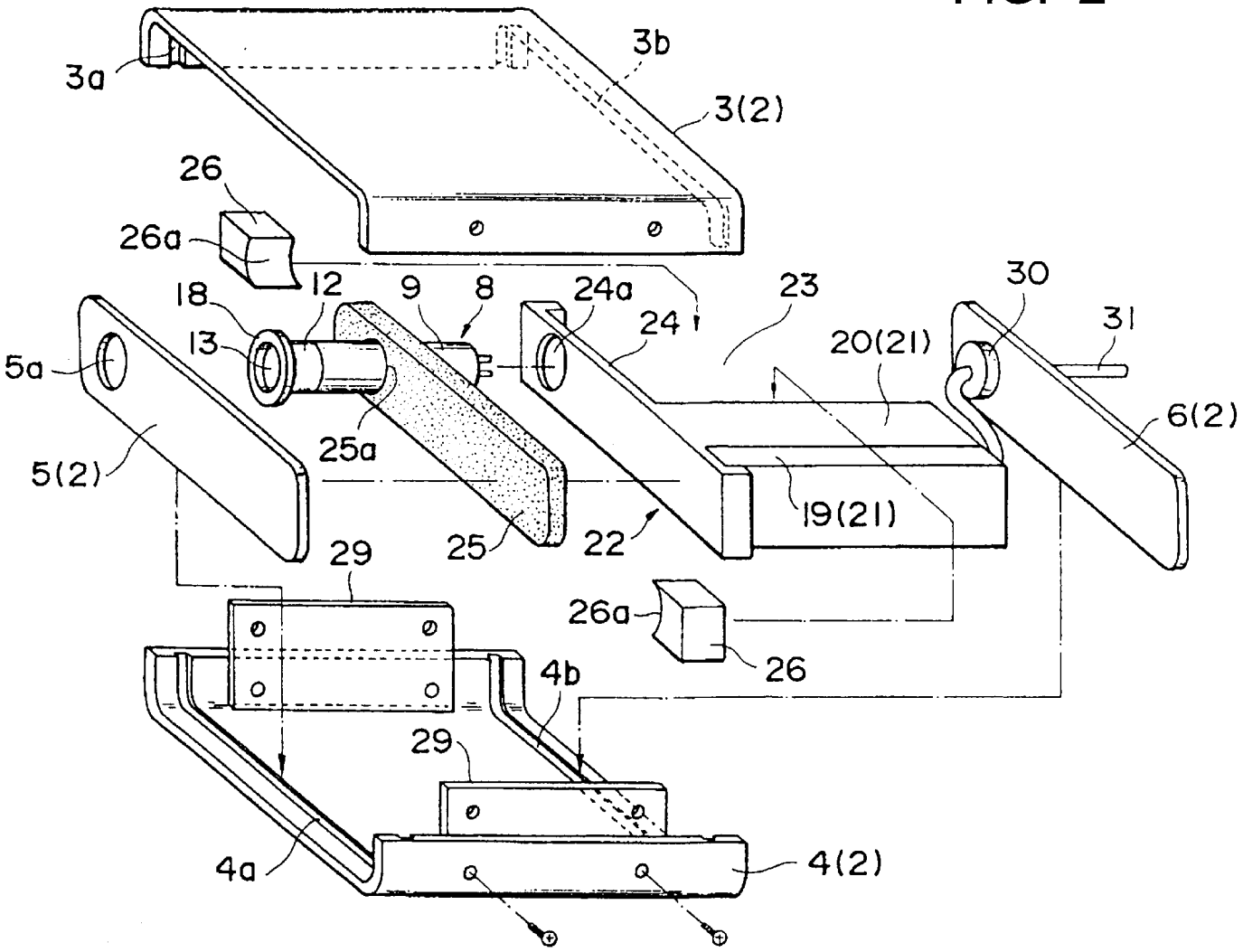
FIG. 2 is a perspective diagram showing the exploded parts of the X-ray generator shown in FIG. 1.

FIG. 1 is a cross-sectional diagram showing an X-ray generator according to the first embodiment. FIG. 2 is a perspective diagram of the X-ray generator with the parts separated. The X-ray generator 1 shown in these diagrams includes a box-type protective case 2 formed of a material high in thermal conductivity, such as aluminum, copper, nickel, and configured in four separate sections. That is, the protective case 2 is a box having four partitions, including a top cover 3 that is flat but curving downward slightly on the sides like an elongated "C" character, a bottom cover 4 that is shaped like the top cover except the sides curve upward, a flat front panel 5, and a flat back panel 6. Two panel support grooves 3*a* and 3*b* are formed in the inner surface of the front and back ends of the top cover 3 for inserting the top ends of the front panel 5 and the back, panel 6, respectively. Similarly, two panel support grooves 4*a* and 4*b* are formed in the inner surface of the front and back ends of the bottom cover 4 for inserting the bottom ends of the front panel 5 and the back panel 6, respectively.

When assembling the protective case 2, the bottom side of reinforcing plates 29 are fixed to the inner surface of the bottom cover 4 by screws. Next, the bottom ends of the front panel 5 and back panel 6 are inserted into the panel support grooves 4*a* and 4*b* in the bottom cover 4. The top cover 3 is placed on top of the bottom cover 4 so that the top ends of the front panel 5 and back panel 6 are inserted into the panel support grooves 3*a* and 3*b* in the top cover 3. The top side of the reinforcing plates 29 are fixed to the inner surface of the top cover 3 with screws, thereby firmly fixing the top cover 3 in relation to the bottom cover 4. In short, the assembly of the protective case 2 is very strong because the front panel 5 and back panel 6 are inserted and held between the top cover 3 and the bottom cover 4.

Figure 3:
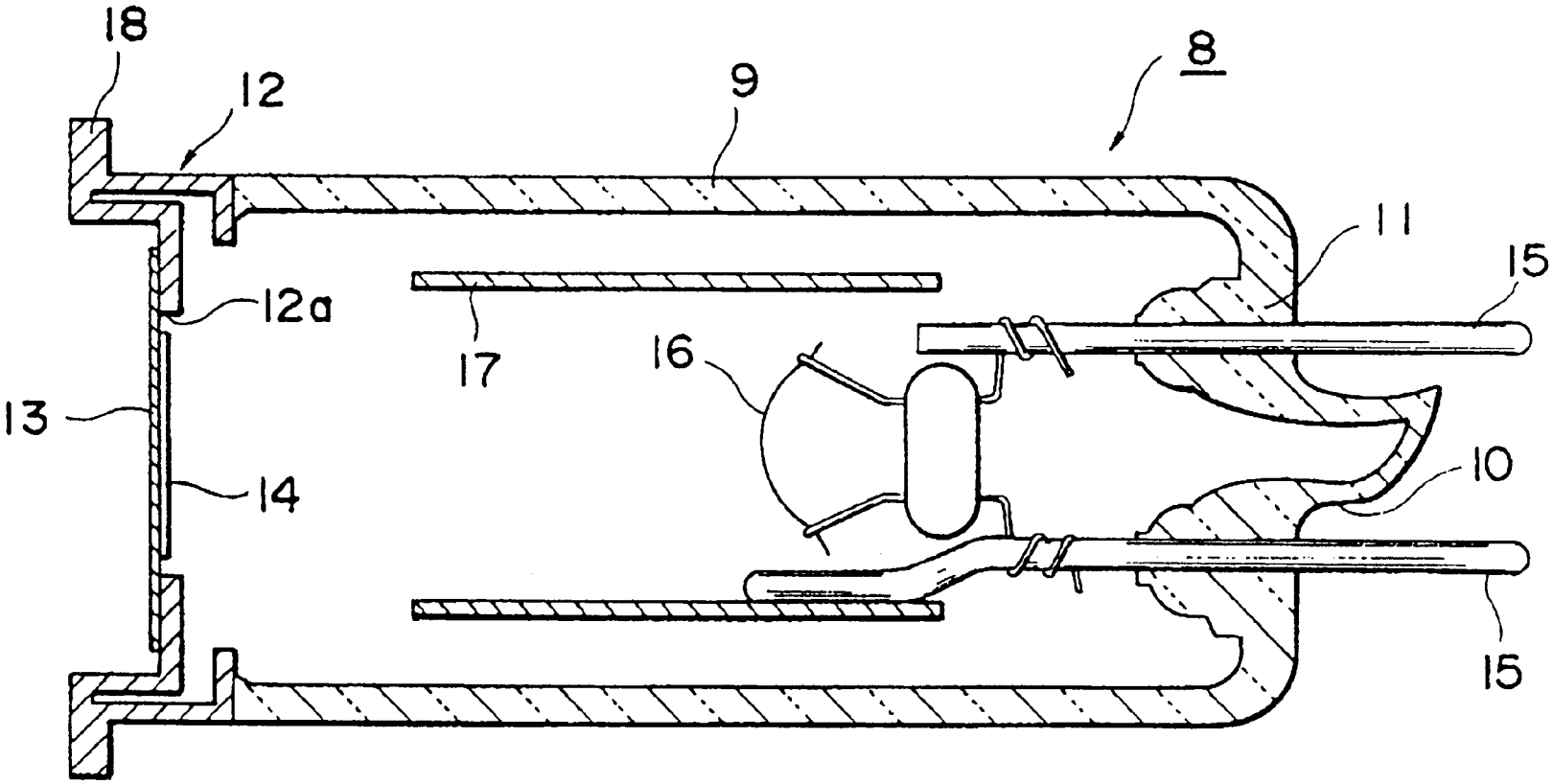
FIG. 3 is a cross-sectional diagram showing an X-ray tube that applies to the X-ray generator according to the first embodiment of the present invention.

An X-ray tube 8 is provided inside the protective case 2 and is used for generating a soft X-ray for various purposes including using it as an electrostatic remover as will be described later. As shown in FIG. 3, the X-ray tube 8 has a cylindrically-shaped bulb 9 formed of kovar glass. A stem 11 is formed on. the end of the bulb 9. The stem 11 has an exhaust tube 10. A cylindrically shaped output window support member 12, which is constructed of kovar metal, is fuse-bonded on the open end of the bulb 9. The output window support member 12 has a central opening 12*a*. A disk-shaped output window 13 is fixed to the output window support member 12 by silver (Ag) brazing so as to seal the central opening 12*a*. A target 14 is evaporated onto the inner surface of the output window 13 for generating X-rays when irradiated by an electron beam.

Two stem pins 15 are fixed on the stem 11. A filament 16 is provided in the bulb 9 as a cathode for emitting electron beams at a prescribed voltage. The filament 16 is fixed on the ends of the stem pins 15. A cylindrical stainless steel focus 17 is fixed on one of the stem pins 15. The output window support member 12, being formed of kovar metal, has electrical and thermal conductivity. Therefore, when electrically connected to the grounded protective case 2, the output window support member 12 has a ground potential and therefore sets the target 14 to a ground potential.

A power source 21, to be described later, supplies a negative high potential of −9.5 kV to the stem pins 15 in the X-ray tube 8, causing the filament 16 to radiate an electron beam toward the ground-potential target 14. When the electron beam collides with the target 14, the target 14 emits X-rays, which radiate outward from the output window 13. With this configuration, the bulb 9 having a diameter of 15 mm and a length of about 30 mm can be used, and the total length of the X-ray tube 8 can be decreased to as small as about 40 mm. However, since the target 14 of the very small X-ray tube 8 reaches high temperatures, it is necessary to cool the target 14 in order to maintain the efficiency of the X-ray generation and to protect the target 14 from damage.

Figure 4:
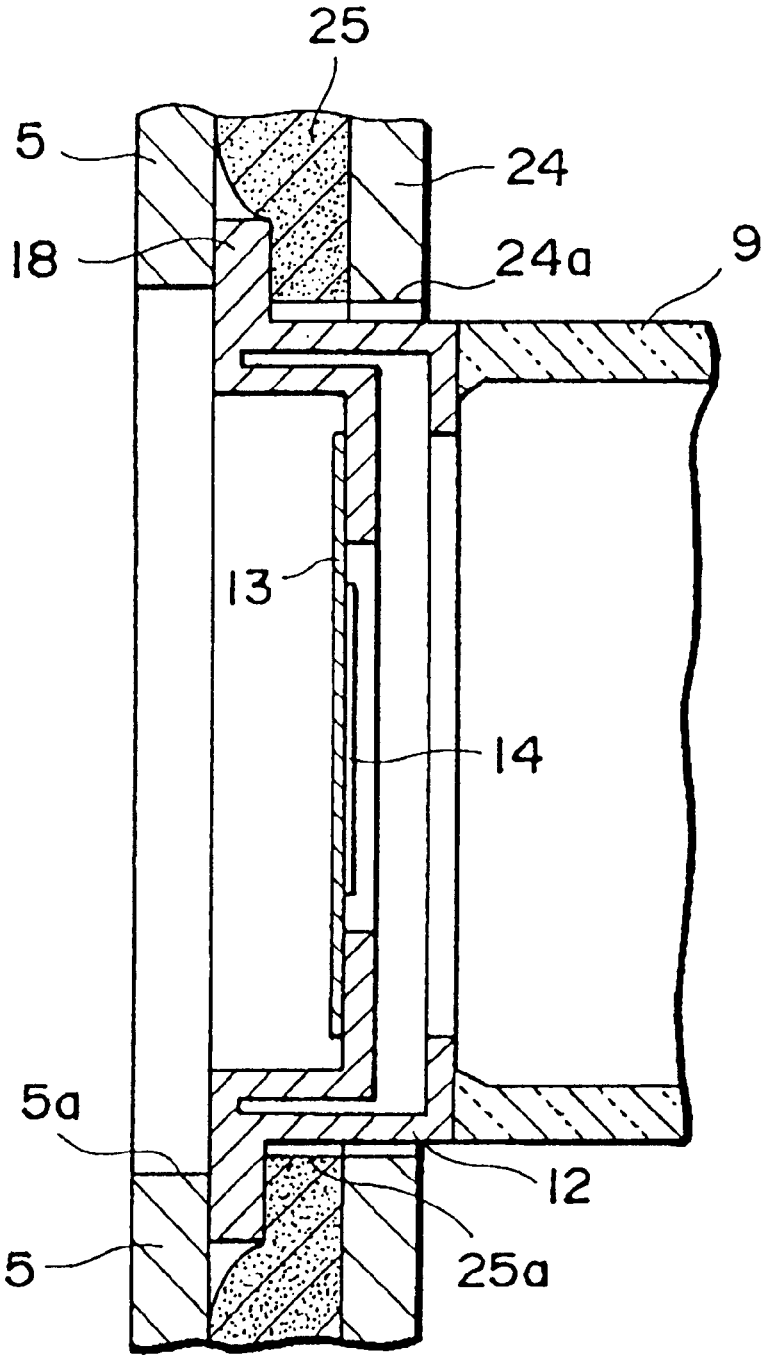
FIG. 4 is an enlarged cross-sectional diagram showing the relevant parts of the X-ray generator shown in FIG. 1.

The cooling method will be described next. A flange portion 18 is formed integrally with the output window support member 12 and protrudes externally from the X-ray tube 8. Since this flange portion 18 is thermally and electrically conductive and contacted with the target 14 via the output window support member 12, the flange portion 18 is heated when heat generated in the target 14 raises the temperature of the output window support member 12 to about 100° C. As shown in FIGS. 1 and 4, the flange portion 18 is fixed to and contacted with the inner surface of the aluminum front panel 5. Hence, heat from the flange portion 18 can be transferred to the protective case 2, and the flange portion 18 can be set to zero potential. A circular X-ray radiation opening 5*a* is provided in the front panel 5 of the protective case 2. By aligning the output window 13 of the X-ray tube 8 with this X-ray radiation opening 5*a*, X-rays can be radiated from within the protective case 2.

Referring back to FIGS. 1 and 2, the power source 21 is housed in the protective case 2 and includes a low voltage generator 19 and a high voltage generator 20. This power source 21 supplies a negative high potential of −9.5 kV to the stem pins 15 for driving the X-ray tube 8. First, the voltage is raised to −1 kV by the low voltage generator 19 and then to −9.5 kV by the high voltage generator 20. This type of power source 21 is fixed inside a steel power source case 22. In addition to the power source case 22, an X-ray tube housing unit 23 is provided for housing the bulb 9 of the X-ray tube 8. This X-ray tube housing unit 23 is provided on the side of and adjoining the power source 21. Since the power source 21 and the X-ray tube housing unit 23 are arranged parallel to each other, the length of the protective case 2 can be shortened.

As shown in FIGS. 2 and 4, a flat first supporting plate 24 is provided on the power source case 22, parallel to and in confrontation with the front panel 5 and forming the front end of the X-ray tube housing unit 23. An opening 24*a* is formed in the first supporting plate 24 for inserting the bulb 9 of the X-ray tube 8. Therefore, when the bulb 9 is inserted through the opening 24*a*, the flange portion 18 is interposed between the front surface of the first supporting plate 24 and the back surface of the front panel 5, serving as the second supporting plate. Since the power source case 22 is fixed to the bottom cover 4 of the protective case 2 with screws, the flange portion 18 is firmly inserted between the first supporting plate 24 of the power source case 22 and the front panel 5 fixed in the panel support grooves 3*a* and 3*b* of the protective case 2. Hence, the flange portion 18 is firmly fixed in the protective case 2.

A thermally conductive intermediate member 25 is sandwiched between the first supporting plate 24 and the front panel 5, which serves as the second supporting plate. This intermediate member 25, composed of silicon rubber, which is flexible and is highly heat conductive, is formed to approximately fill the space between the first supporting plate 24 and the front panel 5. In addition, the intermediate member 25 has an opening 25*a* for inserting the bulb 9. With this configuration, when the flange portion 18 is interposed between the peripheral edge of the opening 24*a* and the peripheral edge of the X-ray radiation opening 5*a*, a peripheral edge of the opening 25*a* in the intermediate member 25 contacts the flange portion 18, while nearly the entire surface of the intermediate member 25 contacts the first supporting plate 24 and the front panel 5. As a result, a heat transfer channel for transferring heat from the flange portion 18 to the front panel 5 is essentially expanded, expediting the dissipation of heat by the aluminum protective case 2. Further, since the intermediate member 25 is flexible, the flange portion 18 can be pressed against the front panel 5, increasing the ability of the X-ray tube 8 to absorb shocks.

As shown in FIGS. 1 and 2, a pair of vibration deadeners 26 are provided inside the X-ray tube housing unit 23 for maintaining the X-ray tube 8 within the protective case 2. These vibration deadeners 26, which are formed of urethane resin, include arcing pressure surfaces 26*a* for gripping the bulb 9. One vibration deadener 26 contacts the reinforcing plate 29 fixed on the side wall of the protective case 2, while the other vibration deadener 26 contacts a partition 22*a* inside the power source case 22. By interposing the bulb 9 between the arced pressure surfaces 26*a*, the X-ray tube 8 can be maintained firmly inside the protective case 2.

The X-ray generator 1 further includes an external lead wire 31 for supplying a specified voltage to the low voltage generator 19 of the power source 21. The external lead wire 31 has a rubber cap 30. By fitting this cap 30 into an opening 6a formed in the back panel 6, the external lead wire 31 is fixed to the protective case 2. Further, cathode lead wires 32 are derived from the high voltage generator 20. By connecting the cathode lead wires 32 to the stem pins 15 of the X-ray tube 8, a high voltage of −9.5 kV can be supplied to the filament 16.

Next, an X-ray generator 41 according to a second embodiment will be described with reference to the accompanying drawings, wherein the X-ray generator 41 has the same structure as the X-ray generator 1 and like parts and components are designated by the same reference numerals to avoid duplicating description.

Figure 5:
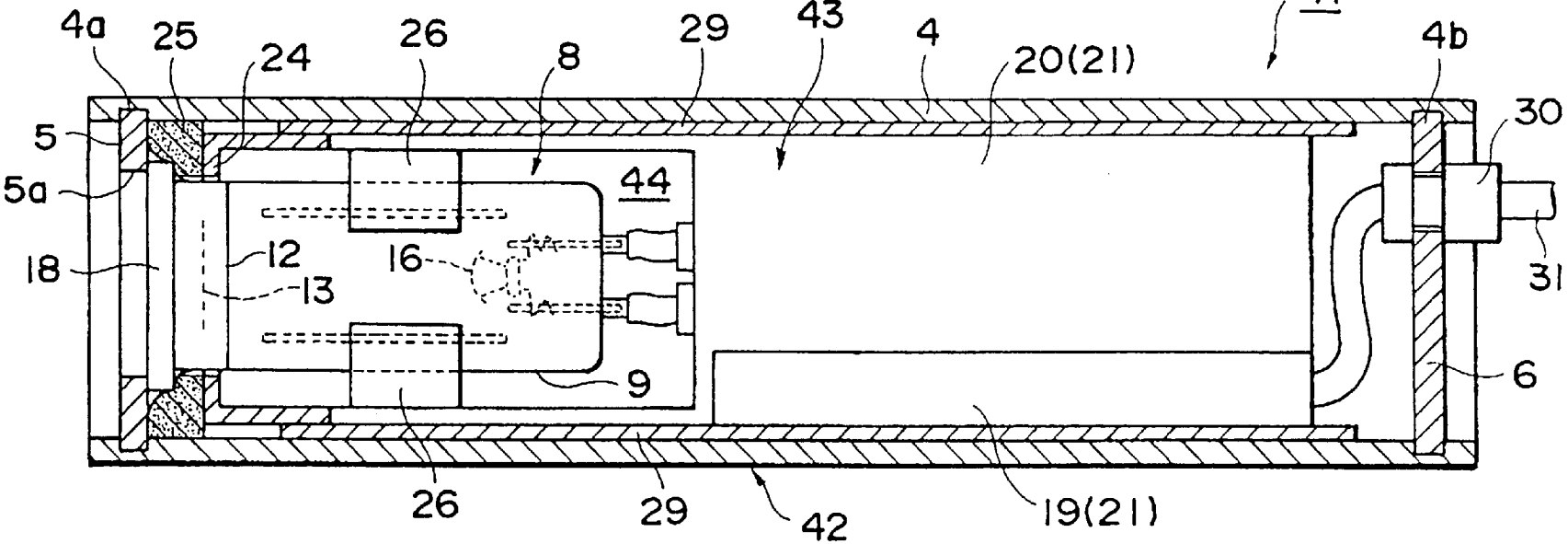
FIG. 5 is a cross-sectional diagram showing the structure of an X-ray generator according to the second embodiment of the present invention.
Figure 6:
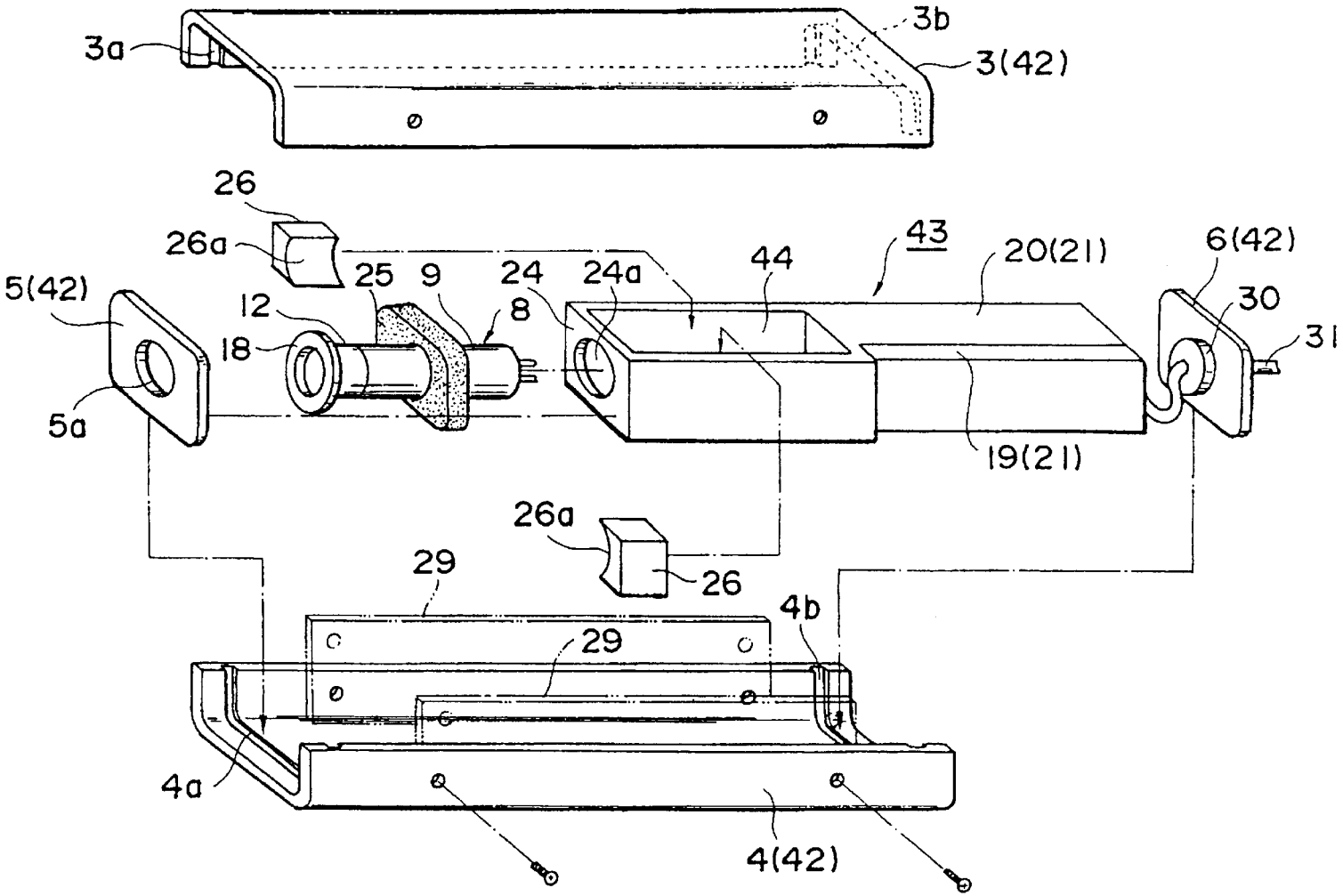
FIG. 6 is a perspective diagram showing the exploded parts of the X-ray generator shown in FIG. 5.

As shown in FIGS. 5 and 6, a protective case 42 is formed in a long, thin shape. A long, thin power source case 43 is housed in the protective case 42. The front portion of the power source case 43 includes an X-ray tube housing unit 44 for housing the X-ray tube 8 and the vibration deadeners 26, while the back portion of the power source case 43 includes the power source 21. With this configuration, the protective case 42 can be formed long and thin by arranging the power source 21 and the X-ray tube housing unit 44 in a series, which can be effective for installing the X-ray generator 41 in narrow spaces. Other structures, such as the front panel 5 and the intermediate member 25, are simply made smaller to fit the formation of the protective case 42, while the functions and. quality of these structures remain the same as in the X-ray generator 1 of the first embodiment.

The X-ray generator configured as described above is best suited when used as an electrostatic remover. The electrostatic remover is a device for removing electrostatic charges on an object, such as semiconductor wafer. During a manufacturing process of integrated circuits (ICs), liquid crystal displays (LCDs) or the like, adhesion of dust particles or other contaminants due to electrostatic attraction is a serious problem. The electrostatic remover can solve such a problem by canceling or removing electrostatic charges buildup on the product. When an X-ray is radiated from the electrostatic remover toward the product which is electrostatically charged to, for example, positive, positive and negative ions of nitrogen and other constituent gases of air are generated. Negative ions thus generated are electrostatically attracted to charge accumulations of opposite polarity and then neutralize such accumulations. The electrostatic remover generates 3 to 9.5 keV X-ray. For the X-ray in such a level, 0.5 mm thick steel plate or 1 mm thick glass plate is sufficient for shielding the ionizing space.

While exemplary embodiments of this invention have been described in detail, those skilled in the art will recognize that there are many possible modifications and variations which may be may in these exemplary embodiments while yet retaining many of the novel features and advantages of the invention. Accordingly, all such modifications and variations are intended to be included within the scope of the appended claims.

Figure 7:
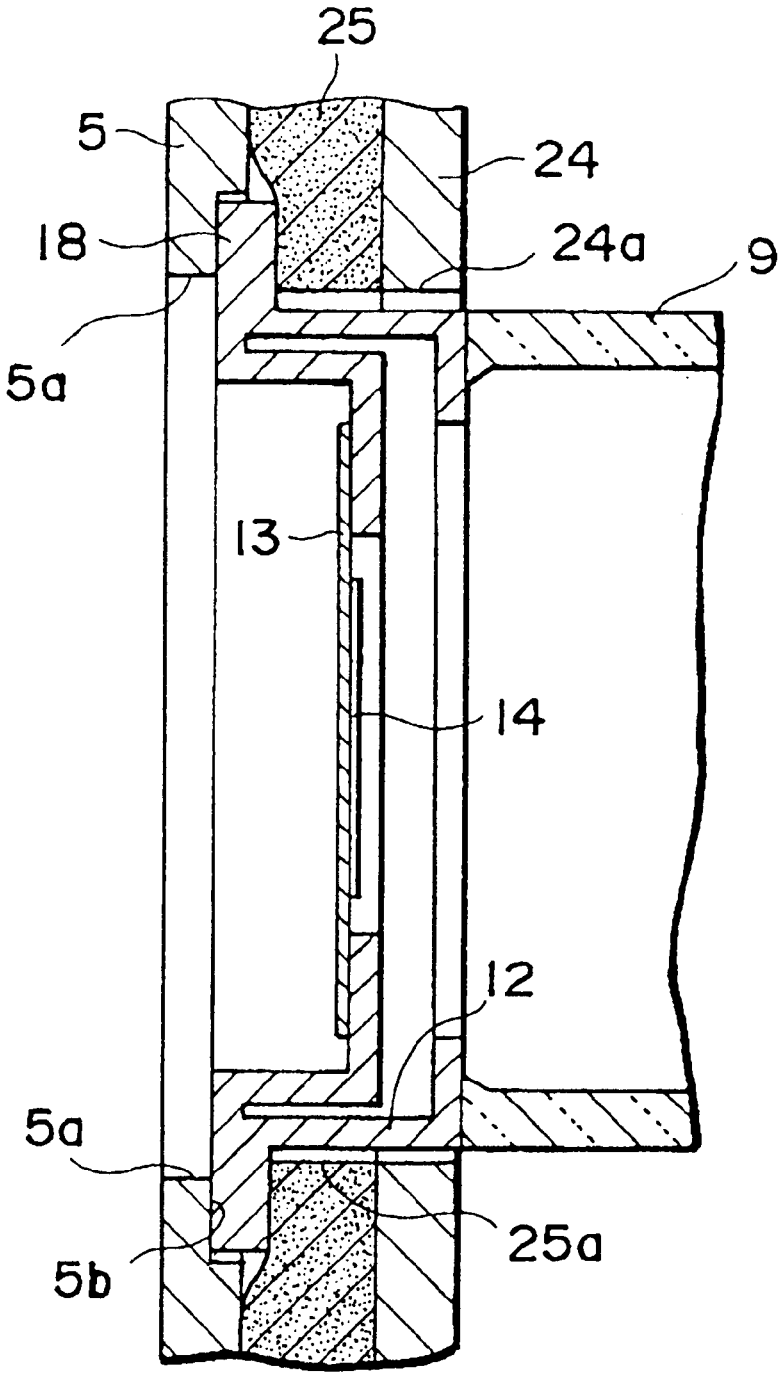
FIG. 7 is an enlarged cross-sectional diagram showing the relevant parts of the X-ray generator shown in FIG. 5.

For example, as shown in FIG. 7, an annular depression 5*b* can be formed in the peripheral edge forming the X-ray radiation opening 5*a* in the front panel 5 for housing the flange portion 18. Hence, the depression 5*b* not only improves the fit of the flange portion 18 in the front panel 5, but facilitates alignment of the output window 13 in the X-ray tube 8 and the X-ray radiation opening 5*a* in the front panel 5. Further, the flange portion 18 can be fixed to be in contact with the front panel 5 using screws or adhesive, not shown in the drawings.

An X-ray generator according to the present invention has the following advantages. An X-ray generator houses within a protective case both an X-ray tube containing a cathode for irradiating a target with an electron beam, in which X-ray tube the target having a ground potential is fixed to the inner surface of an output window, which in turn is fixed to an electrically and thermally conductive output window support provided on the end of a bulb; and a power supply for driving the X-ray tube. A flange portion formed on the output window support so as to protrude externally contacts and is fixed to the thermally conductive protective case. As a result, heat in the X-ray tube, which is often the source of declining efficiency of X-ray generation and the source of damage to the target, can be transferred to the protective case and dissipated externally, while the cooling structure for the X-ray tube can be made compact and at a low cost. Further, through appropriate cooling of the X-ray tube, the electrical circuit inside the power source will not be adversely affected.

What is claimed is: :

1. An X-ray generator comprising:

a protective case elongated in its axial direction, said protective case being made from a thermally conductive material and connected, in use, to ground;

an X-ray tube housed within said protective case, said X-ray tube including:

a bulb having a first end portion and a second end portion;

a cathode housed within said bulb;

an output window having an inner surface;

an output window support attached to the first end portion of said bulb so as to be electrically connected to said bulb, and supporting said output window, said output window support being made from a thermally conductive material;

a flange portion formed on said output window support so as to protrude externally, said flange portion being made from a thermally and electrically conductive material and thermally and electrically coupled to said protective case;

a target fixedly attached to the inner surface of said output window and having a ground potential, wherein said cathode irradiates said target with an electron beam, causing said target to generate an X-ray which is directed outwardly from said bulb through said output window, and a power source assembly housed within said protective case, said power source assembly including a power source for supplying a negative voltage to said cathode, and a power source case for housing said power source therein, whereby said target, said output window, said output window support, said flange portion and said protective case are thermally and electrically connected.

2. The X-ray generator as claimed in claim 1, wherein said power source case is provided with an X-ray tube supporting unit for supporting said X-ray tube, said X-ray tube supporting unit comprising a first supporting plate that defines said power source case, and a second supporting plate disposed in confrontation with said first supporting plate, and wherein said flange portion is supported between said first supporting plate and said second supporting plate.

3. The X-ray generator as claimed in claim, 2, wherein said X-ray supporting unit further comprises an intermediate member made from a thermally conductive material and positioned between said first supporting plate and the second supporting plate, and wherein said flange portion is interposed between said first supporting plate and said second supporting plate via said intermediate member, thereby providing a heat transfer channel for transferring heat from said flange portion to said second supporting plate and expediting dissipation of heat by said protective case.

4. The X-ray generator as claimed in claim 3, wherein openings are formed in said first supporting plate, said intermediate member, and said second supporting plate for inserting said bulb thereinto.

5. The X-ray generator as claimed in claim 4, wherein said intermediate member is made from silicon rubber.

6. The X-ray generator as claimed in claim 1, wherein said X-ray tube and said power source case are disposed in parallel to each other.

7. The X-ray generator as claimed in claim 1, wherein said X-ray tube and said power source case are disposed in series along the axial direction of said protective case.

8. The X-ray generator as claimed in claim 1, wherein said target generates soft X-ray.

9. The X-ray generator as claimed in claim 1, wherein said protective case is formed with an X-ray radiation opening that is aligned with said output window.

10. An electrostatic remover for removing electrostatic charges on an object, comprising:

a protective case elongated in its axial direction, said protective case being made from a thermally conductive material and connected, in use, to ground;

an X-ray tube housed within said protective case, said X-ray tube including:

a bulb having a first end portion and a second end portion;

a cathode housed within said bulb;

an output window having an inner surface;

an output window support attached to the first end portion of said bulb so as to be electrically connected to said bulb, and supporting said output window, said output window support being made from a thermally conductive material;

a flange portion formed on said output window support so as to protrude externally, said flange portion being made from a thermally and electrically conductive material and thermally and electrically coupled to said protective case;

a target fixedly attached to the inner surface of said output window and having a ground potential, wherein said cathode irradiates said target with an electron beam, causing said target to generate an X-ray which is directed toward the object through said output window, and a power source assembly housed within said protective case, said power source assembly including a power source for supplying a negative voltage to said cathode, and a power source case for housing said power source therein, whereby said target, said output window, said output window support, said flange portion and said protective case are thermally and electrically connected.

11. The electrostatic remover as claimed in claim 10, wherein said power source case is provided with an X-ray tube supporting unit for supporting said X-ray tube, said X-ray tube supporting unit comprising a first supporting plate that defines said power source case, and a second supporting plate disposed in confrontation with said first supporting plate, and wherein said flange portion is supported between said first supporting plate and said second supporting plate.

12. The electrostatic remover as claimed in claim 11, wherein said X-ray supporting unit further comprises an intermediate member made from a thermally conductive material and positioned between said first supporting plate and the second supporting plate, and wherein said flange portion is interposed between said first supporting plate and said second supporting plate via said intermediate member, thereby providing a heat transfer channel for transferring heat from said flange portion to said second supporting plate and expediting dissipation of heat by said protective case.

13. The electrostatic remover as claimed in claim 12, wherein openings are formed in said first supporting plate, said intermediate member, and said second supporting plate for inserting said bulb thereinto.

14. The electrostatic remover as claimed in claim 13, wherein said intermediate member is made from silicon rubber.

15. The electrostatic remover as claimed in claim 10, wherein said X-ray tube and said power source case are disposed in parallel to each other.

16. The electrostatic remover as claimed in claim 10, wherein said X-ray tube and said power source case are disposed in series along the axial direction of said protective case.

17. The electrostatic remover as claimed in claim 10, wherein said target generates soft X-ray.

18. The electrostatic remover as claimed in claim 10, wherein said protective case is formed with an X-ray radiation opening that is aligned with said output window.

* * * * *